US005862569A

United States Patent [19]

Wood

[11] Patent Number: 5,862,569

[45] Date of Patent: Jan. 26, 1999

[54] DOOR CLOSER HOLDING PLATE

[76] Inventor: Don Wood, 406 W. Fireweed Ln. Suite 101, Anchorage, Ak. 99503

[21] Appl. No.: 727,918

[22] Filed: Oct. 9, 1996

[51] Int. Cl.[6] ..... E05F 1/00; E05F 3/00

[52] U.S. Cl. ..... 16/49; 16/DIG. 17

[58] Field of Search ..... 16/49, 65, 70, 16/71, 72, 80, 223, DIG. 17

[56] References Cited

U.S. PATENT DOCUMENTS

| | | | |
|---|---|---|---|
| D. 337,042 | 7/1993 | Lin et al. | D8/348 |
| 1,721,967 | 7/1929 | Mohr | 16/72 |
| 3,891,111 | 6/1975 | Snazuk | 16/72 |
| 4,190,926 | 3/1980 | Cronin | 16/65 |

*Primary Examiner*—Chuck Mah
*Assistant Examiner*—Donald M. Gurley
*Attorney, Agent, or Firm*—Michael J. Tavella

[57] ABSTRACT

A plate that is attached to a shaft to remove a door closer from the door completely. A door holder is used to set the plate in an "open" position, out of the way of the door. Once the plate is in the open position, the door is free to open and close without any force on it at all. If there is an emergency, the door holder releases the plate. The door closer then moves the plate against the door and closes the door. Once the door is closed, the plate can be reset by opening the door until the door holder is again engaged. In this way, people can operate the door without exertion while they are protected from emergencies.

11 Claims, 7 Drawing Sheets

DOOR CLOSER HOLDING PLATE

This invention relates to a plate for holding door closers and particularly to a plate for holding door closers that permits a door to operate independently of the door closer.

BACKGROUND OF THE INVENTION

Today, most commercial buildings have automatic door closers to keep building doors closed. Fire safety is the biggest reason for having door closers because they prevent the spread of fire and help protect building occupants. Door closers typically have a significant counter force when a door is being opened. For the elderly or infirm, this force can often prevent them from opening a door. This can be dangerous at worst and inconvenient at best.

Many areas prohibit propping open a door to defeat the door closer. As a result, door holders have been developed that counter the door closer. These door holders are designed to hold a door open, but in an emergency such as a fire, they are designed to release the door so that the door closer can close it. Door holders are an improvement over constantly having to fight a door closer. However, they do not allow privacy because the door is held open continuously.

Some devices have been developed to try to solve this problem. U.S. Pat. No. 4,979,261 teaches a variable position door closer. This device uses a rack and gears to move the door closer in a linear path as the door is opened or closed. This movement reduces the force needed to open and close the door. This makes operation of the door closer easier for the elderly and infirm. Another answer to the problem uses powered door openers to counter the force of the door closer. A user simply presses a button and the motor driven door opener does the work. Although these devices are convenient, they are costly and sometimes require reconstruction around the door. Thus, they tend to be used in high traffic areas of a building. They are too expensive to put on all the patients' doors in a rest home, for example. An example of this type of system is found in U.S. Pat. No. 5,375,374. The above mentioned solutions work; but at high cost and inconvenience. The problem with these solutions is that they are too limited. Although they solve the problem of overcoming the force of a door closer, they do so in an expensive and excessive manner.

SUMMARY OF THE INVENTION

The instant invention overcomes the problem of door closers and door operation by eliminating the problem altogether. Unlike the inventions discussed above, the instant invention solves the problem by separating the door closer from the door itself. The invention uses a plate that is attached to a shaft to remove the door closer from the door completely. A door holder is used to set the plate in an "open" position, out of the way of the door. Once the plate is in the open position, the door is free to open and close without any force on it at all. If there is an emergency, the door holder releases the plate and the door closer moves the plate against the door—in whatever position the door is in—and closes the door. Once the door is closed, the plate can be reset by opening the door until the door holder is engaged. In this way, people can operate the door without exertion while they are protected from emergencies. Unlike the door holder, which keeps the door open continuously, or the door closer, which effectively keeps the door closed, this device allows a user to keep the door closed or open as desired.

The device is a mounting plate that holds a standard door closer assembly, and a door holder mounting bracket. A length of angle iron is attached to one end of the plate. This angle iron runs down along the edge of the door, next to the hinges. Two hinge rings are attached to the angle iron. These rings are used to secure the plate to the door hinges. To install the device, the hinge pins are removed from the upper and center door hinges. Then, hinge rings are aligned with the door hinges. Finally, the hinge pins are passed through the hinge rings and door hinges to secure the device in place. One can use longer hinge pins if desired, but longer hinge pins are not necessary. Once attached to the hinges, the plate and angle iron can rotate freely. The door closer and door holder are then attached. Once all the equipment is in place, the door is opened until the door holder reaches its normal full extended position. At this point, the plate is at its furthest point of travel. Once the door holder is set, the door, which is not connected to the plate, is free to open and close without resistance.

It is an object of this invention to produce a holding plate for door closers that permits a door to freely open and close once the door closer is in place.

It is another object of this invention to produce a low cost device for allowing a door to open and close freely while using a door closer.

It is a further object of this invention to produce a device that can enable the elderly, the young and the infirm to freely operate doors, yet be protected by door closer devices.

DETAILED DESCRIPTION OF THE INVENTION

Figure 1:
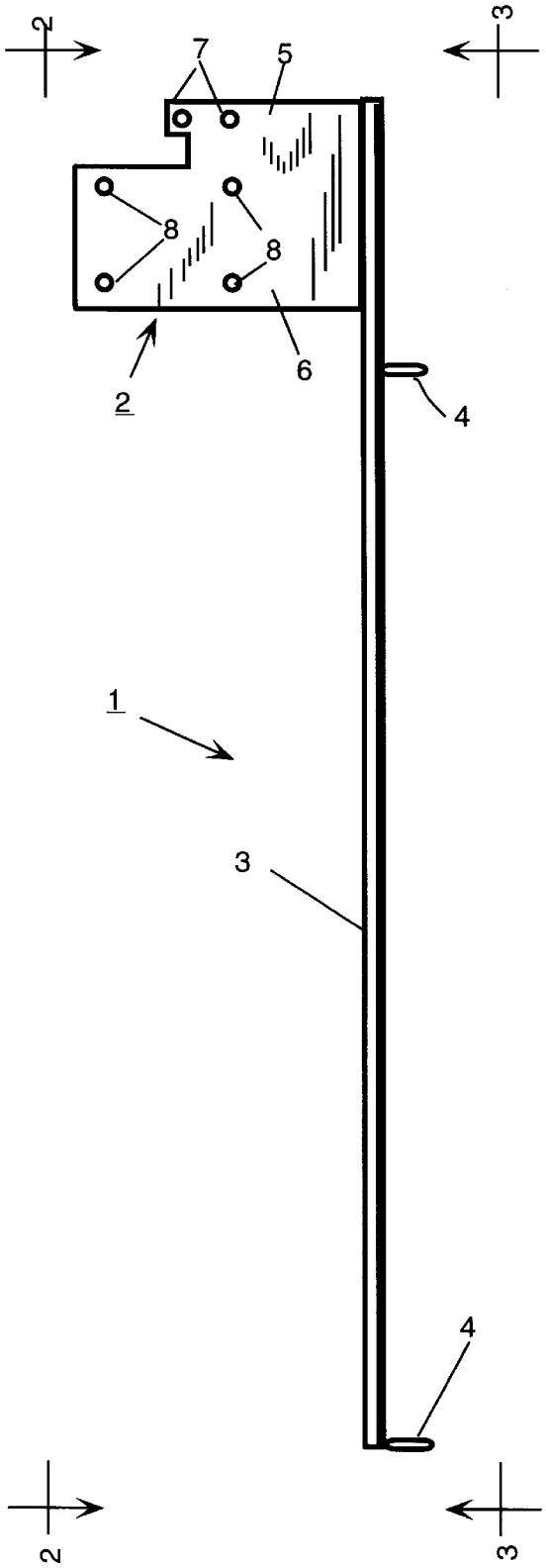
FIG. 1 is a front view of the invention.
Figure 2:
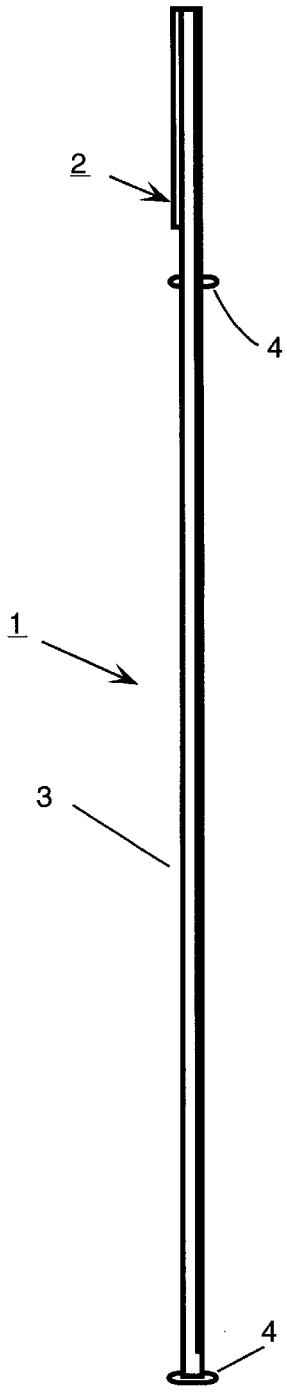
FIG. 2 is a left side elevational view taken along the lines 2—2 of FIG. 1.
Figure 3:
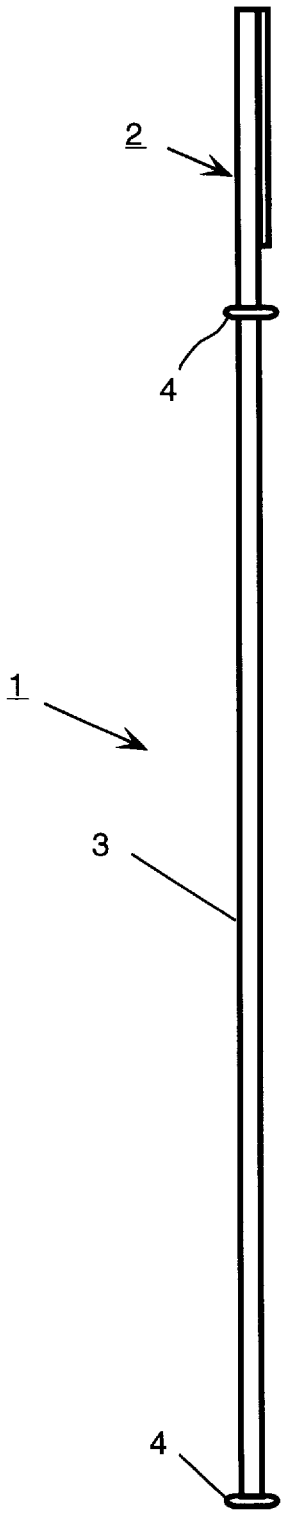
FIG. 3 is a right side elevational view taken along the lines 3—3 of FIG. 1.
Figure 4:
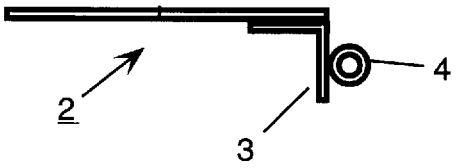
FIG. 4 is a top view of the invention.

Referring now to FIG. 1, a front view of the device 1 is shown. The device 1 has four main parts: a mounting plate 2, a support arm 3, and two hinge rings 4. The mounting plate 2 is shown as being generally rectangular and having an upper portion 5. The upper portion 5 is used to support a door holder operating arm 100*a*, which is normally attached to the top of a door 20. Ordinarily, the door holder 100 is mounted above the door (see, e.g., FIGS. 6 and 8). The door holder operating arm 100*a* is typically attached to the door itself. Here, however, it is attached to the top of the mounting plate 2. The larger lower portion 6 is used to hold a door closer 101. Mounting holes 7 are provided in the upper portion 5 of the mounting plate 2 to allow the door holder operating arm 100*a* to be bolted to the mounting plate 2. A set of lower mounting holes 8 is provided to secure the door closer 101. FIG. 2 shows the device 1 from the left side. FIG. 3 shows the device 1 from the right side. Notice that in these views, the mounting plate 2 is relatively thin. The support arm 3 is shown in the preferred embodiment to be a length of angle iron. See also, FIG. 4. Of course, a round rod can also be used, as well as any similar shape desired. The angle iron is preferred because it allows the mounting plate 2 to lie flush in one plane with the support arm 3. See FIG. 4.

Figure 5:
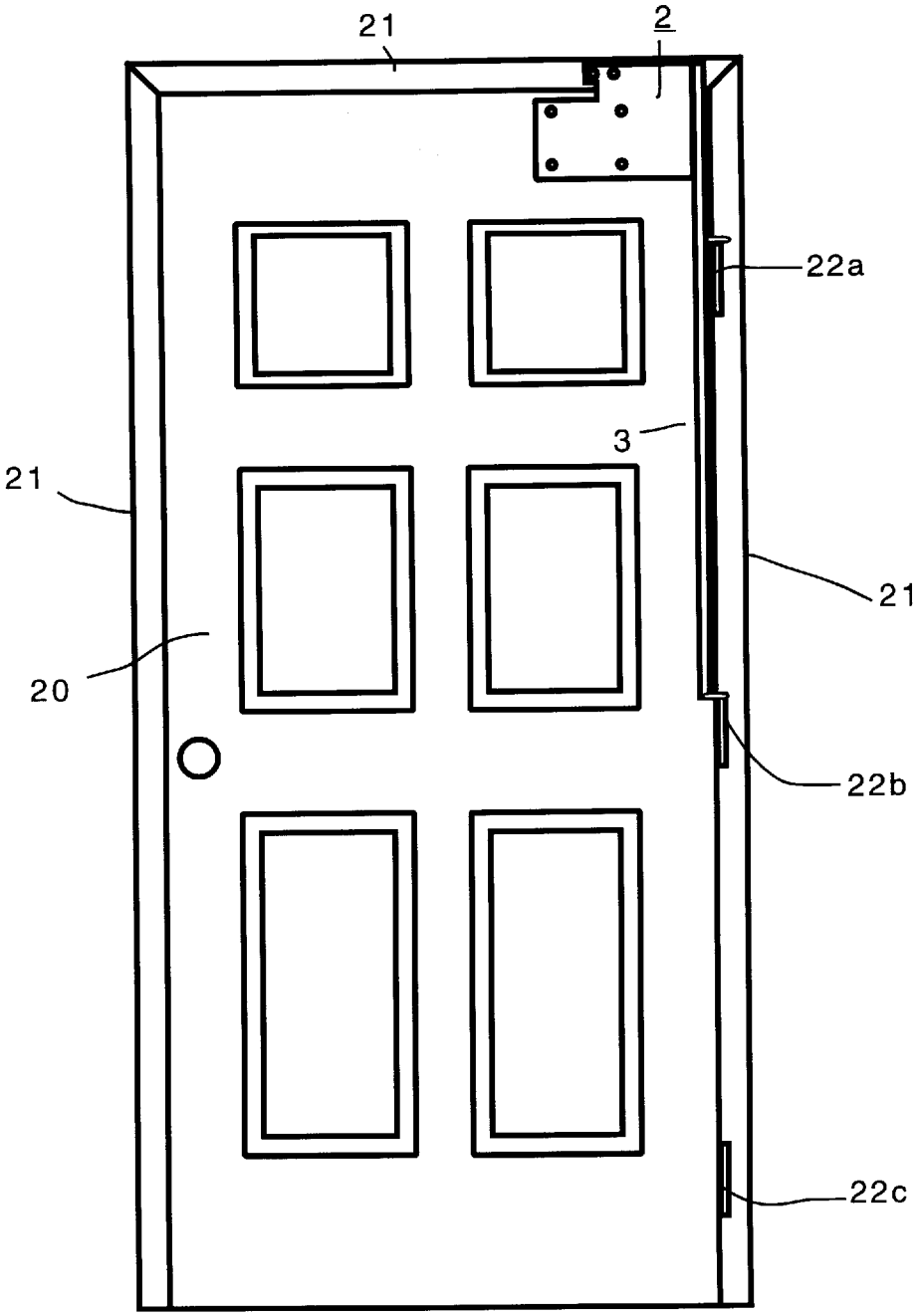
FIG. 5 is a detail view of the invention mounted on door hinges with no closer or holder attached.

FIG. 5 shows the device 1 as installed on a typical door frame. This frame has a door 20, an outer casing 21 and a number of hinges 22*a*, 22*b*, and 22*c*. Typically, three hinges are used on door installations. One hinge 22*a* is attached a few inches below the top of the door 20, one hinge 22*b* is attached at the center of the door 20 and one 22*c* is installed near the bottom of the door 20 as shown. In the preferred embodiment, the support arm 3 has two hinge rings 4 attached. The placement of the hinge rings corresponds to the locations of the top 22*a* and center hinges 22*b* on the door installation. Of course, the number of rings can be increased to match additional hinges on some heavy duty doors. However, while it is possible to extend the arm 3 all the way to the floor, it is not necessary or practical to do so.

Figure 7:
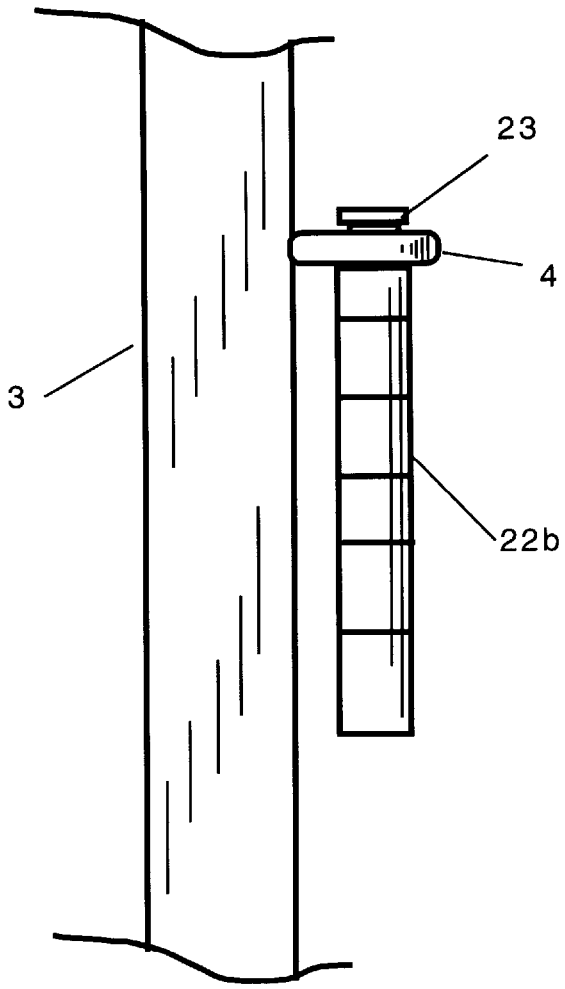
FIG. 7 is a detail view of a typical hinge showing the hinge ring being held in place by a hinge pin.

As shown in FIG. 5, the support arm 3 is designed to extend down to the top of the center hinge 22*b*. The mounting plate 2 is designed to lie where the normal placement of the door closer 101 and door holder 100 are normally installed. However, the mounting plate 2 abuts, but is not attached, to the door 20. FIG. 7 shows a detail of a typical hinge 22*b* with the device 1 in place. To install the device 1, the hinge pins 23 are removed from hinges 22*a* and 22*b*, the device 1 is then placed against the door 20 so that the hinge rings 4 align with the tops of the hinges 22*a* and 22*b*. Hinge pins 23 are then reinstalled. In most installations longer hinge pins 23 may be used to compensate for the thickness of the hinge rings 4, although it is not absolutely necessary to do so. Once the hinge pins 23 are in place, the device 1 is fully installed. Note that, other than attachment at the hinges, the device 1 is not otherwise connected to the door 20.

Figure 6:
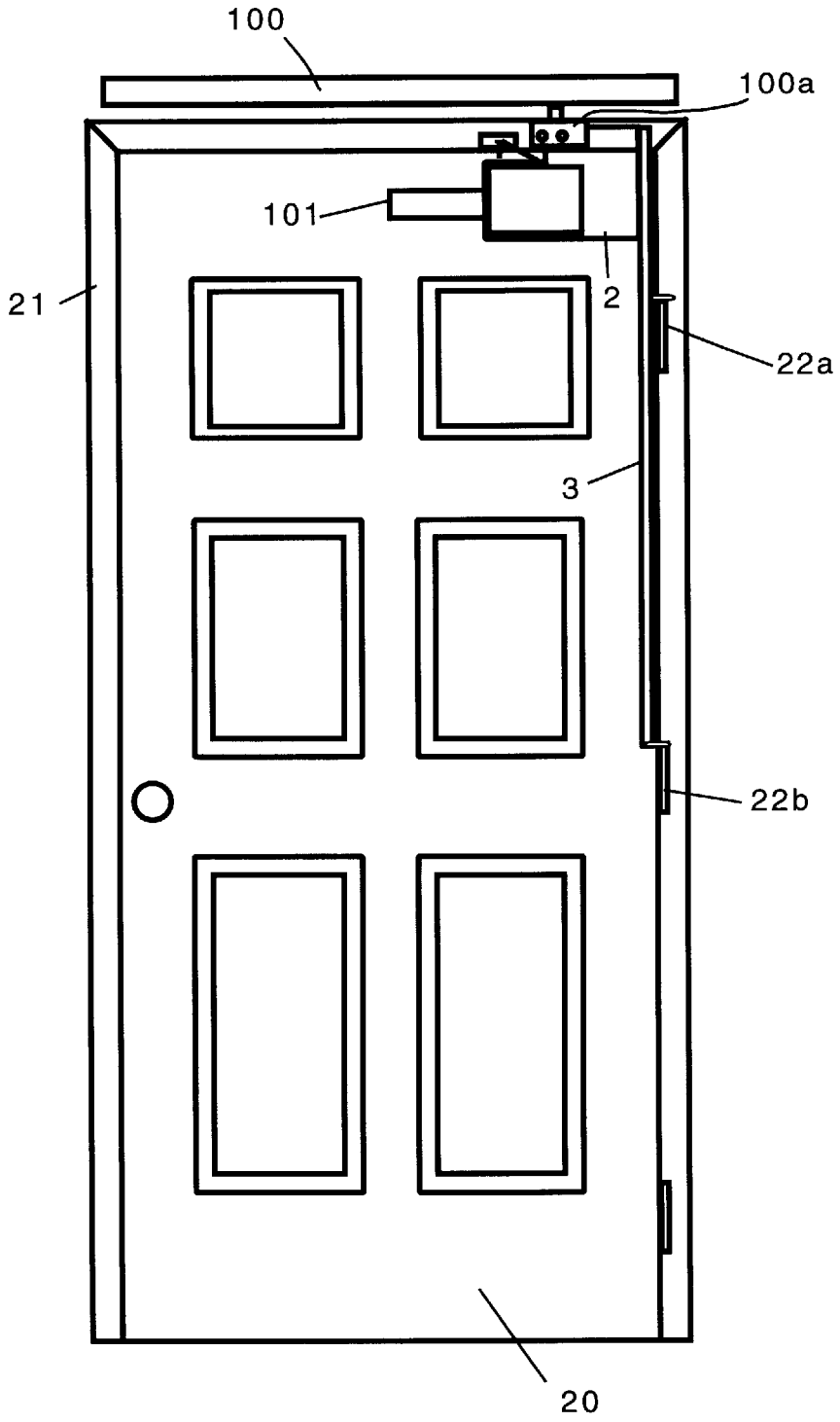
FIG. 6 is a front view of door showing the device and the door in the fully closed position.
Figure 8:
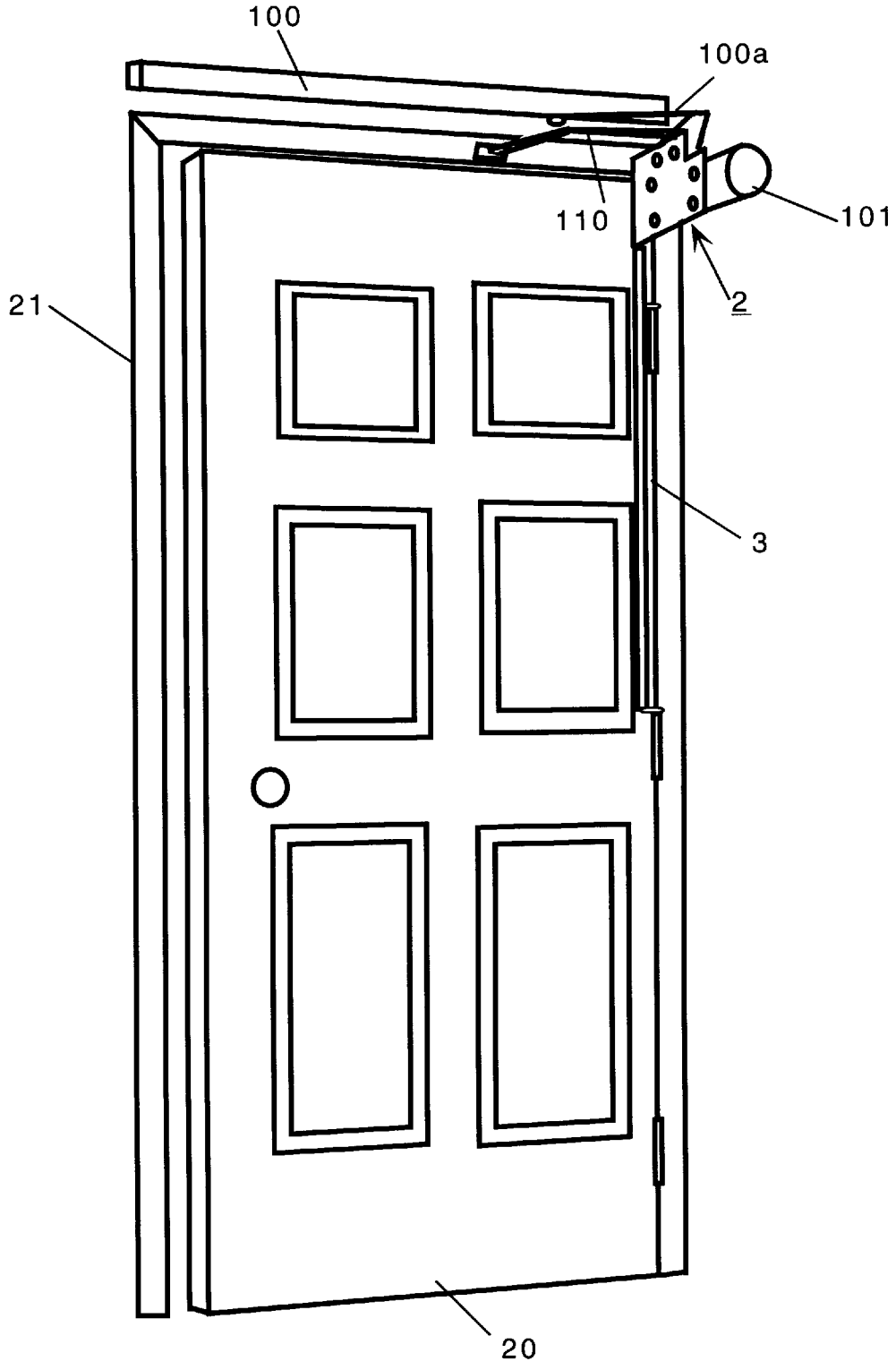
FIG. 8 is a perspective view of door showing the device in the fully open position, being held by a door holder, while the door is only slightly ajar.

Referring now to FIGS. 6 and 8, the door holder operating arm 100*a* and door closer 101 are shown attached to the mounting plate 2. The body of the door closer 101 is attached to the mounting plate 2. An operating arm 110 for the door closer 101 is extended and attached to the space above the door, such as the casing, as shown in FIG. 8. See also FIG. 8. Of course, the configuration of the mounting plate 2 can be adjusted to fit any commercial type of door holder and door closer sold. The drawings here are an example of one type of closer/holder combination and are only meant to illustrate one method of assembly and are not meant to be limiting in their nature. The installation of door closers and door openers is well known in the art and their installation and use is not a part of this patent application per se.

FIG. 8 shows the device 1 in its fully open position. Once this position is locked in place with the door holder 100, the door 20 can swing freely. The mounting plate 2 remains in the open position, held by the door holder operating arm 100*a*. As shown in the FIG. 8, the door 20 here is shown slightly ajar, but can be easily moved to any position desired without much force. In an emergency, or other circumstances, the door holder 100 releases the arm 100*a*. The door closer 101 then pushes the mounting plate 2 back towards its closed position. During this movement, the mounting plate 2 contacts the door 20 at whatever position the door 20 is in. The door closer 101 then continues to push the mounting plate 2 and the door 20 until both the mounting plate 2 and the door 20 are fully closed. See FIG. 6. The door closer 101 holds the door 20 closed until the door 20 is opened again. To reset the device 1, the door 20 is opened to its full extent, which moves the mounting plate 2 to its full extent. At this point, the door holder 100 engages and holds the mounting plate 2 in its fully opened state, while the door 20 is again free to open and close as desired.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A device that permits a door, having hinges, to operate independently of a door closer and a door holder comprising:

a) a means for mounting a door closer, having a closed position and an open position, corresponding to a closed position and an open position of a door;

b) a means for mounting a door holder operating arm, fixedly attached to the means for mounting, a door closer; and c) a means for attaching said means for mounting a door closer to a door, having hinges, whereby when said door is fully opened, a door holder operating arm maintains the means for mounting a door closer in an open position, while the door is free to move from a closed position to an open position without restraint, said means for attaching including at least one ring, fixedly attached to said means for attaching whereby said means for attaching is removably attached to said door hinges by said ring.

2. The device of claim 1 wherein the means for attaching is rotatably attached to the door hinges.

3. The device of claim 1 wherein the means for mounting a door closer comprises a flat plate.

4. The device of claim 3 wherein the means for mounting a door holder operating arm, comprises an extension formed on said flat plate.

5. The device of claim 3 wherein the means for attaching said means for mounting a door closer to said door comprises:

a) a length of angle iron, fixedly attached to said flat plate and extending downwardly therefrom; and b) at least one hinge ring, fixedly installed to said length of angle iron and positioned thereon such that said hinge ring aligns with a door hinge.

6. The device of claim 5 wherein the hinge ring is attached to said door hinge by passing a hinge pin through said hinge ring and said door hinge.

7. A device that permits a door, having hinges to operate independently of a door closer, and a door holder having an operating arm, comprising:

a) a flat plate being generally rectangular, said flat plate having a plurality of mounting holes formed therein to receive and mount a door closer and a door holder operating arm;

b) a vertical support member, fixedly attached to a vertical edge of said flat plate and extending downwardly therefrom; and c) at least one hinge ring, fixedly installed to said vertical support member and positioned thereon such that said hinge ring aligns with a door hinge.

8. The device of claim 7 wherein said vertical support member comprises a length of angle iron.

9. The device of claim 7 wherein the hinge ring is secured to said door hinge by a hinge pin.

10. A device that permits a door, having hinges to operate independently of a door closer, and a door holder having an operating arm, comprising:

a) a flat plate; being generally rectangular, said flat plate having a plurality of mounting holes formed therein to receive and mount a door closer and a door holder operating arm;

b) a length of angle iron, having a top and a bottom, fixedly attached to a vertical edge of said flat plate and extending downwardly therefrom;

c) a first hinge ring, fixedly installed near the top of said length of angle iron and positioned thereon such that said first hinge ring aligns with an upper door hinge; and d) a second hinge ring, fixedly installed near the bottom of said length of angle iron and positioned thereon such that said second hinge ring aligns with a central door hinge.

11. The device of claim 10 wherein the first and second hinge rings are secured to said upper and central door hinges by hinge pins.

* * * * *